United States Patent [19]

Holmes

[11] 3,950,818

[45] Apr. 20, 1976

[54] SELF LATCHING CABINET HINGE HAVING A RESILIENT TENSION STRAP

[75] Inventor: Frank A. Holmes, Sherman Oaks, Calif.

[73] Assignee: Jaybee Manufacturing Corporation, Los Angeles, Calif.

[22] Filed: Dec. 6, 1974

[21] Appl. No.: 530,193

[52] U.S. Cl. ..... 16/180; 16/142

[51] Int. Cl.[2] ..... E05F 1/12

[58] Field of Search ..... 16/180, 142, 145, 143

[56] References Cited

UNITED STATES PATENTS

| | | | |
|---|---|---|---|
| 3,629,899 | 12/1971 | Deadrick | 16/142 |
| 3,842,463 | 10/1974 | Wehner | 16/180 |

FOREIGN PATENTS OR APPLICATIONS

| | | | |
|---|---|---|---|
| 94,431 | 9/1936 | Sweden | 16/142 |

*Primary Examiner*—Paul R. Gilliam
*Assistant Examiner*—Doris L. Troutman
*Attorney, Agent, or Firm*—Flam & Flam

[57] ABSTRACT

The hinge comprises a pair of hinge members pivotally connected by a hinge pin. One hinge member, while made of relatively flexible plastic, is made dimensionally rigid between spaced fasteners by virtue of its attachment to one cabinet member. A flexible strap integrally formed on the one hinge member is engaged by a cam part of the companion hinge member to generate a substantial turning torque between the members as a function of angular movement, the turning torque reaching a maximum and changing directions just before a limit of relative angular movement is achieved whereby a self-closing or self-latching results.

5 Claims, 3 Drawing Figures

SELF LATCHING CABINET HINGE HAVING A RESILIENT TENSION STRAP

RELATED APPLICATIONS

This application is related to application Ser. No. 296,938 filed Oct. 12, 1972 entitled SPRINGLESS SELF-LATCHING HINGE HAVING A RESILIENT HINGE MEMBER.

BACKGROUND OF THE INVENTION

The present invention relates to self-latching hinges, and particularly to a hinge that develops its spring force by stressing one of the hinge members itself.

Self-latching hinges have gained substantial acceptance in the building industry for the reason that separate latch hardware is obviated. Self-latching hinges are quite old. U.S. Pat. No. 2,145,689 to Hanle shows a box closure utilizing an overcenter cam and leaf spring arrangement. U.S. Pat. No. 2,522,997 to Rotter shows a lens cover that utilizes a coil spring and a latching recess. The principle of such self-latching hinges has been applied to cabinets. The basic problem is to develop an adequate spring force sufficient to operate a relatively massive cabinet door. A successful structure is shown and described in U.S. Pat. No. 3,205,532 to MacDonald. The MacDonald structure utilizes a strong prestressed spring that is captured in one of the hinge members. The spring urges a roller against the hinge knuckle of the companion hinge member and into a recess that begins to register with the roller when the companion hinge member approaches closed position. A high torque is imposed notwithstanding the small lever arm by virtue of the fact that the spring is very strong.

The problem with the MacDonald structure is that the spring is not easily assembled. Complicated fixtures are required. The basic object of the present invention is to provide a very simple self-closing hinge structure that generates a very substantial closing force without requiring any prestressed or other springs.

SUMMARY OF THE INVENTION

In order to accomplish the foregoing objective, use is made of companion hinge members, one of which is made of relatively flexible plastic that, by virtue of its attachment to a cabinet member, acquires dimensional rigidity between spaced fasteners. Between these a flexible strap formed integrally with the hinge member is anchored at opposite ends near these places of attachment. The strap is engaged by a cam member of the companion hinge member and is resiliently stressed thereby to a maximum just prior to arrival of the hinge members to closed position. The torque direction changes and a self-closing function is thereby achieved. A substantial stress is developed by the strap because the ends of the strap are firmly anchored, a feature that depends upon the hinge member being rigidly attached to a cabinet. No heavy spring structure is required to be incorporated in the hinge members themselves.

BRIEF DESCRIPTION OF THE DRAWINGS

A detailed description of the invention will be made with reference to the accompanying drawings wherein like numerals designate corresponding parts in the several figures. These drawings, unless described as diagrammatic or unless otherwise indicated, are to scale.

DETAILED DESCRIPTION OF THE PREFERRED EMBODIMENT

Figure 1:
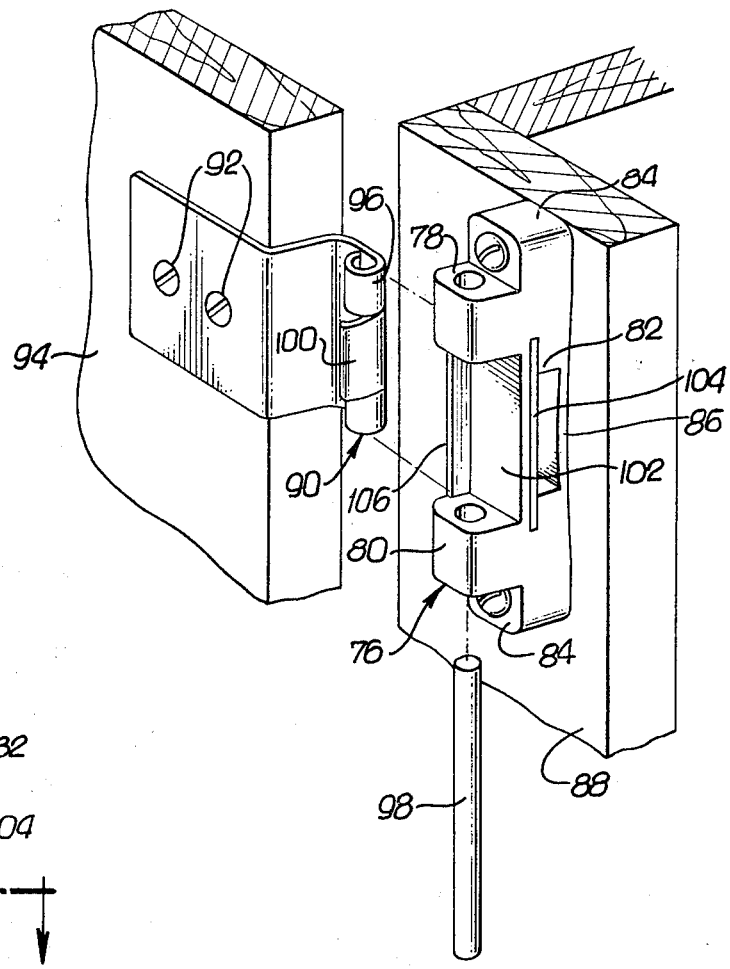
FIG. 1 is an exploded perspective view of a self-latching hinge incorporating the present invention.
Figure 2:
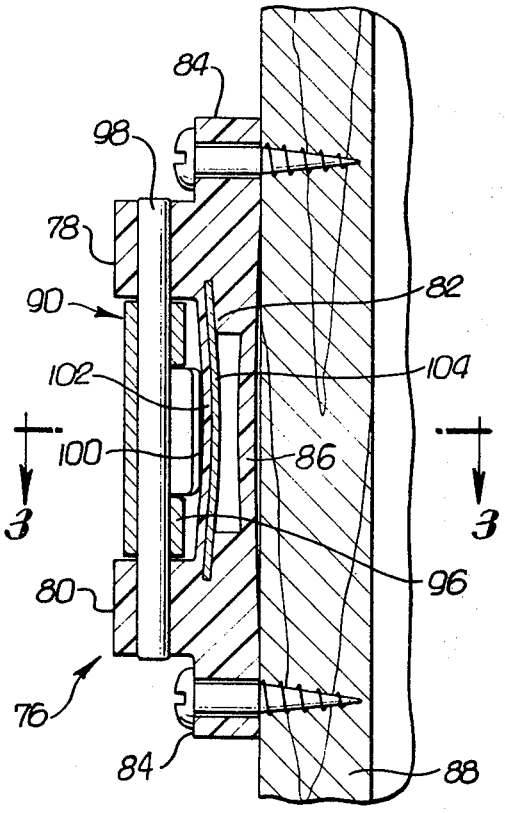
FIG. 2 is an axial sectional view of the latch of FIG. 1, and shown in closed position.

The following detailed description is of the best presently contemplated mode of carrying out the invention. This description is not to be taken in a limiting sense, but is made merely for the purpose of illustrating the general principles of the invention since the scope of the invention is best defined by the appended claims.

A resilient hinge member 76 is made of molded plastic and provides a pair of spaced hinge knuckles or hinge pin bearing blocks 78 and 80 that project outwardly from the mounting base 82. Flanges 84 at the ends of the base beyond the bearing blocks serve as means for screw or other attachment to a cabinet part 88. A relatively thin web 86 extends between the flanges 84 along the base of the hinge member. The under surface of the web 86 is concavely curved whereby the central protion of the hinge member may be flexed towards its supporting cabinet part and away from the pin axis determined by the blocks 78 and 80.

The companion hinge member 90 is made of generally rigid material and is attached, as by screws 92 to the cooperating cabinet part 94. The rigid hinge member 90 provides a knuckle 96 positioned between the bearing blocks 78 and 80 to receive the hinge pin 98.

The hinge members 76 and 90 have cooperating latch parts generally similar to those shown and described in U.S. Pat. No. 588,652, issued Aug. 24, 1897 to Hoffman. Thus the hinge knuckle 96 has a central part that extends radially outwardly to form a cam 100. The cam 100 engages a strap 102 of the companion hinge member 76. The strap extends in superimposed parallel relationship to the web 86. The strap 102 is itself flexible and resilient. Its ends are firmly anchored by virtue of the attachment of the base flanges 84 to the cabinet.

The flat outer surface of the strap 102 normally extends in a plane parallel to the hinge axis, and on opposite sides of the normal plane (corresponding to section plane 2—2) which passes through the hinge axis. See FIG. 3. In the closed position, the cam 100 engages the strap 102 on one side of the line of intersection of these planes. Hence increasing deflection of the strap 102 is required in moving the rigid hinge member to open position whereby the closed position is stable. Upon sufficient movement of the rigid hinge member away from closed position, a position is reached at which the deflection moves through a maximum, allowing the hinge members to move apart freely. Upon reverse movement, increasing stress is developed until the position of maximum fluxure is passed, whereupon the stored energy snaps the members into fully closed position determined in this instance by engagement of the cabinet parts. The fully closed position of the hinge member could be determined by mutually engaging parts of the hinge member rather than by engagement of the cabinet parts.

The spring force developed is quite high since the ends of the strap 102 are restrained. The stress in the strap 102 is transmitted to the hinge member 76 as a whole, which tends to rock the base flanges 84 and to flatten the web 86. The longitudinal stress in the hinge member 76 is in turn transmitted to the cabinet 88 through the fasteners. The entire hinge member 76 becomes a working spring unit by virtue of its being attached at spaced points to a rigid cabinet member 88.

Figure 3:
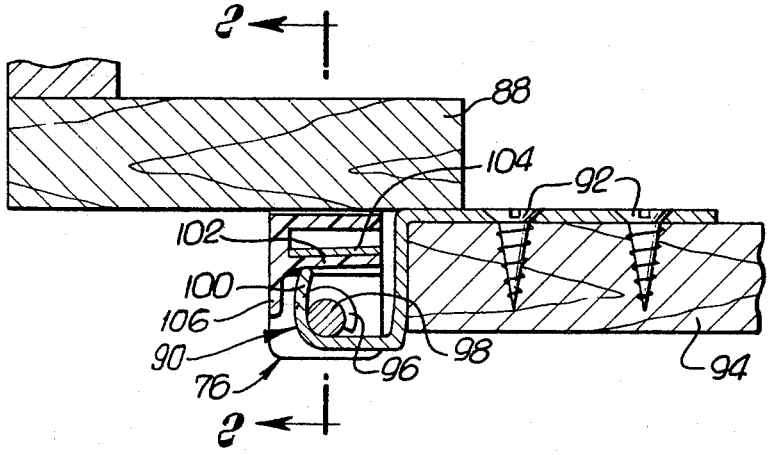
FIG. 3 is a transverse sectional view taken along a plane corresponding to line 3—3 of FIG. 2, there being indicated in FIG. 3 by line 2—2, the section plane of FIG. 2.

In order to conceal the operative elements of the hinge and thus to provide a neat appearance, the hinge member 76 has a wall 106 that extends along one side of the flanges 84, web 86, and strap 102 as shown in FIGS. 1 and 3. The wall 106 is joined to one side edge of the strap 102.

In order to distribute the force imposed by the cam 100 over the strap 102 and to prevent the strap from being degraded, a backing strip 104 of resilient spring material is provided thus ensuring long life to the unit. If the plastic material has sufficient wear resistant characteristics, the strip 104 may not be needed.

A variety of plastic materials can be used including Nylon, Teflon, or other tough resilient materials.

Intending to claim all novel, useful and unobvious features shown or described, I make the following claims:

1. In a self-latching hinge structure:

a. a pair of hinge members;

b. one of said hinge members being made of resilient plastic material and having a base having provisions at spaced portions thereof for rigid attachment to a cabinet;

c. said one hinge member having a strap, the ends of said strap being anchored adjacent said spaced portions with the intermediate portion of said strap normally extending straight between its ends but free resiliently to deflect laterally;

d. the other of said hinge members being relatively rigid and pin connected to said one hinge member for angular movement therebetween from a closed position to an open position;

e. said other hinge member having a cam part opposed to and engageable with said strap upon relative angular movement between said hinge members;

f. said cam part being located to bow and thereby longitudinally stress said strap to a maximum when said hinge members are near, but spaced from, the closed position of said hinge members;

g. the longitudinal stress generated in said strap being transmitted to the said one hinge member and to the corresponding cabinet member, said stress being substantially larger when the said one hinge member is rigidly attached to said cabinet than otherwise whereby the rigidity of said cabinet imparts high spring constant characteristics to said hinge structure.

2. The hinge structure as set forth in claim 1 in which said one hinge member has a base web underlying and spaced from said strap, said base web being normally concave to allow said web to flatten against said cabinet upon the existence of stress generated upon the existence of longitudinal tension in said strap.

3. The combination as set forth in claim 1 together with a spring strip extending behind the strap to distribute the forces generated in the strap and to avoid localized deformation.

4. In a self-latching hinge structure:

a. a pair of hinge members, one of said hinge members being relatively rigid and the other of said hinge members being made of relatively flexible and resilient plastic material;

b. means joining said hinge members for relative angular movement about a hinge axis, said hinge members having a limited closed position;

c. means rigidly attaching the flexible hinge member to a cabinet at places spaced along the hinge axis;

d. said flexible hinge member having a normally flat strap extending generally parallel to, but spaced from, said hinge axis, with ends anchored adjacent said spaced places, said strap having a central portion capable of deflection away from said hinge axis with generation of longitudinal stress therein as well as in the hinge member anchoring the ends of the said strap;

e. said rigid hinge member having a cam part movable upon relative angular movement of said hinge members to engage said strap to flex it laterally;

f. said cam part being located to cause said strap to be flexed to a maximum when said hinge members are adjacent, but slightly spaced from, said closed position; and g. said longitudinal stress being resisted by said flexible hinge member only when attached to said cabinet.

5. The self-closing hinge structure as set forth in claim 4 in which said flexible hinge member has a web extending beneath said strap in spaced relationship thereto, said strap being normally bowed away from the cabinet, said web being flattened upon generation of stress in said strap.

* * * * *